US012532938B2

(12) United States Patent
McLeod

(10) Patent No.: US 12,532,938 B2
(45) Date of Patent: Jan. 27, 2026

(54) ARTICLE OF FOOTWEAR FOR SAND SURFACES

(71) Applicant: Cheryl McLeod, Moorestown, NJ (US)

(72) Inventor: Cheryl McLeod, Moorestown, NJ (US)

( * ) Notice: Subject to any disclaimer, the term of this patent is extended or adjusted under 35 U.S.C. 154(b) by 0 days.

(21) Appl. No.: 17/711,338

(22) Filed: Apr. 1, 2022

(65) Prior Publication Data

US 2022/0322783 A1 Oct. 13, 2022

Related U.S. Application Data

(60) Provisional application No. 63/172,911, filed on Apr. 9, 2021.

(51) Int. Cl.
*A43B 3/12* (2006.01)
*A43B 1/10* (2006.01)
*A43B 1/14* (2006.01)

(52) U.S. Cl.
CPC ..... *A43B 3/128* (2013.01); *A43B 1/10* (2013.01); *A43B 1/14* (2013.01); *A43B 3/126* (2013.01)

(58) Field of Classification Search
CPC ..... A43B 3/12; A43B 3/126; A43B 3/128
USPC ..... 36/11.5; D2/951, 960
See application file for complete search history.

(56) References Cited

U.S. PATENT DOCUMENTS 2,032,206 A * 2/1936 Goldberg ..... A43B 3/126 36/11.5
2,367,232 A * 1/1945 Marx ..... A43B 3/24 36/15
2,773,317 A * 12/1956 Jens ..... A43B 3/122 36/11.5
D189,839 S * 3/1961 Nakashima ..... D2/917
3,468,040 A * 9/1969 Tatuo ..... A43B 3/108 36/11.5
3,605,292 A * 9/1971 Goldblatt ..... A43B 13/226 36/8.1
3,662,478 A * 5/1972 Schwab ..... A43B 13/223 36/59 C
4,094,081 A * 6/1978 Reiner ..... A43B 3/128 36/11.5
4,124,946 A * 11/1978 Tomlin ..... A43B 7/1435 36/43
D321,778 S * 11/1991 Austin ..... D2/960
D378,239 S * 3/1997 Bramani ..... D2/960
5,746,014 A * 5/1998 Tanemoto ..... A43B 3/105 36/8.1

(Continued)

*Primary Examiner* — Marie D Bays
(74) *Attorney, Agent, or Firm* — Pro se

(57) ABSTRACT

The present invention relates to an article of footwear for walking on sand and other surfaces. The outsole of the footwear includes a lugged tread pattern like that of a tractor tire for traction while walking on sand and other like surfaces. Cushioning on the insole moderates the impact when a wearer walks on a hard surface. The footwear has an upper section to cover a portion of the foot of a user and provides a semi-closed design, wherein the upper section has a pair of inter-woven flaps and is sewn or glued to the insole of the footwear. The footwear is available in various sizes, styles, and designs to accommodate all adults and children. The footwear can be worn in any outdoor setting to maintain stability on sand, gravel, grass, dirt, and other like surfaces, while the footwear is also suitable to wear in other outdoor and indoor settings.

20 Claims, 5 Drawing Sheets

(56) References Cited

U.S. PATENT DOCUMENTS 5,787,608 A * 8/1998 Greenawalt ..... A61F 5/14 36/169
5,901,394 A * 5/1999 Greenawalt ..... A43B 17/02 36/11.5
6,681,502 B1 * 1/2004 Birkenstock ..... A43B 3/103 36/15
D523,614 S * 6/2006 Mitchell ..... D2/951
D593,291 S * 6/2009 Chen ..... D2/954
10,104,931 B1 * 10/2018 Krastev ..... A43B 3/103
D960,546 S * 8/2022 Bikowski ..... D2/947
2004/0118019 A1 * 6/2004 Ito ..... A43C 11/12 36/9 R
2005/0262726 A1 * 12/2005 Ferniani ..... A43B 3/128 36/8.1
2008/0022561 A1 * 1/2008 Klavano ..... A43B 7/146 36/141
2009/0133288 A1 * 5/2009 Gallegos ..... A43B 7/223 36/71
2010/0088928 A1 * 4/2010 Sarantakos ..... A43C 11/1493 36/103
2010/0251563 A1 * 10/2010 Oliveira ..... A43B 3/106 36/11.5
2015/0368455 A1 * 12/2015 Akahori ..... C08L 23/12 525/89
2016/0095378 A1 * 4/2016 Kriegel ..... A43B 3/0078 36/11.5
2016/0160037 A1 * 6/2016 Hanna ..... B29D 35/122 264/143
2017/0202300 A1 * 7/2017 Sherman ..... A43B 13/386
2017/0325539 A1 * 11/2017 Yen ..... A43B 3/126
2018/0213888 A1 * 8/2018 Armon ..... A43B 17/003
2019/0116925 A1 * 4/2019 Darby ..... A43B 7/1405
2019/0184629 A1 * 6/2019 Kerrigan ..... A43B 13/14
2020/0008521 A1 * 1/2020 Lam ..... A43B 13/186

* cited by examiner

ARTICLE OF FOOTWEAR FOR SAND SURFACES

CROSS-REFERENCE TO RELATED APPLICATION

The present application claims priority to, and the benefit of, U.S. Provisional Application No. 63/172,911, which was filed on Apr. 9, 2021 and is incorporated herein by reference in its entirety.

FIELD OF THE INVENTION

The present invention relates generally to an article of footwear. More specifically, the present invention relates to footwear or a sandal with a relatively deep staggered lugged tread on the bottom surface, thereby allowing wearers of the sandal to walk comfortably on sand and on other surfaces. The article of footwear is primarily comprised of an insole, a bottom sole or outsole and an upper portion covering a portion of the insole. The outsole has a deep staggered lugged tread like that of a tractor tire, thereby allowing the wearer of the sandal to better walk on sand, dirt or other movable surfaces. The upper portion of the footwear is composed of two interwoven flaps, wherein a first flap passes through a slit in the second flap. The two-piece interwoven upper portion covers a portion of a wearer's foot while providing easy slip-on use. Accordingly, the present disclosure makes specific reference thereto. Nonetheless, it is to be appreciated that certain aspects of the present invention are also equally applicable to other like applications, devices, and methods of manufacture.

BACKGROUND OF THE INVENTION

By way of background, people love to walk and play on beaches and other sandy surfaces. Current footwear designs, more specifically sole designs, have flat bottoms that are comfortable to wear and do not work well when walking, running, jumping or otherwise moving on sand or dirt. The flat bottoms slide on the sand and dirt resulting in slips and falls.

Slips and falls often occur when people wearing flat bottom footwear are playing a game such as beach volleyball or even when walking on sand. The lack of traction in the conventional flat bottom footwear can lead to serious injury for the wearers of flat bottom footwear.

To avoid slips and falls, people may wear conventional street shoes on beaches. When conventional street shoes get wet they may be ruined. Even if they are not ruined, conventional street shoes can take a long time to dry if they get wet. To avoid ruining their conventional street shoes people may wear flip-flops. Though flip-flops are not ruined by water, sand, or dirt and also dry quickly, they are uncomfortable for the wearers as they do not provide adequate support to the arch or the heel of the wearer's foot. More importantly, flip-flops have flat bottoms with minimal tread which contribute to slips and falls on sand and dirt.

Therefore, there exists a long-felt need in the art for an article of footwear that is optimized for walking on sand, dirt and other like surfaces. There is also a long-felt need in the art for an article of footwear that increases traction and stability for a wearer when walking or running on sand, dirt and other like surfaces. Additionally, there is a long-felt need in the art for an article of footwear that is easy to wear, is not damaged by sand, dirt, or water, and dries easily. There is a long-felt need in the art for an article of footwear that is flexible while also providing cushioning and support to the arch and heel of a wearer's foot. Moreover, there is a long-felt need in the art for an article of footwear that can be slipped on easily without the need for tying or fastening. Further, there is a long-felt need in the art for an article of footwear that does not slip off the user while walking, and does not accumulate sand or dirt. Finally, there is a long-felt need in the art for an article of footwear that is optimized for walking on sand, dirt and other like surfaces, and can also be worn in any outdoor or indoor setting.

The subject matter disclosed and claimed herein, in one embodiment thereof, comprises slip-on beach footwear. The slip-on beach footwear provides optimized walking on sand, dirt and other like surfaces. More specifically, the slip-on footwear includes an insole having a top surface, a bottom sole, or outsole, having a tread with two sets of lugs across the bottom surface, and a pair of interwoven flaps providing a semi-closed design to the footwear wherein one of the flaps has a slit through which the other flap passes through. The opposite ends of each flap are sewn or glued along a portion of the longitudinal edges of the insole. The two sets of lugs each extend toward the edges of the bottom sole from a central longitudinal axial line of the bottom sole. The lugs are designed to increase contact surface area and traction on sand, dirt, and other like surfaces.

In this manner, the novel article of footwear of the present invention accomplishes all the forgoing objectives, and provides a relatively safe, durable, easy to use lightweight footwear or sandal optimized for walking on sand and dirt. The footwear increases traction and reduces the tendency to slip and fall on sand, dirt or other like surfaces. On hard surfaces, the impact is moderated by the cushioning of the insole. The footwear can be put one and taken off from the foot easily without bending, tying or fastening, and can be cleaned and dried quickly and easily.

SUMMARY OF THE INVENTION

The following presents a simplified summary in order to provide a basic understanding of some aspects of the disclosed innovation. This summary is not an extensive overview, and it is not intended to delineate the scope of the invention. Its sole purpose is to present some general concepts in a simplified form as a prelude to the more detailed description that follows.

The subject matter disclosed and claimed herein, in one embodiment thereof, comprises a slip-on footwear. The slip-on footwear is configured and designed for providing optimized walking on sand such as on a beach. The slip-on footwear further comprises an insole having a top surface, a bottom sole having a lugged tread design across the bottom surface and a pair of interwoven flaps providing a semi-closed design to the footwear, wherein one of the flaps has a slit through which the other flap passes through. Opposite ends of each flap are sewn or glued along a portion of the longitudinal edges of the insole. The lugs extend toward the edges of the bottom sole from a central longitudinal axial line through the approximate center of the bottom sole. The lugged tread design increases the contact surface area and traction on sand, dirt or like surfaces.

In a further embodiment of the present invention, an article of footwear for comfortable walking in sand and other types of surfaces is disclosed. The article includes a top sole having a heel cup at the rear portion, a bottom sole, a plurality of lugs uniformly distributed along the bottom surface of the bottom sole and an upper portion formed of a pair of inter-woven flaps. Each flap is flexible, generally rectangular and is sewn along the longitudinal edges of the top sole. One of the flaps has a slit through which the other flap passes through to form the inter-woven structure. The lugged tread design is patterned like a tractor tire.

In a further embodiment of the present invention, an optimized sand walking sandal is disclosed. The sandal includes an insole having a forefoot portion and a heel portion, the heel portion has extra cushioning and the forefoot portion is open, allowing free movement of the wearer's toes. A bottom sole having lugs extending towards the longitudinal edges from the central longitudinal axial line provides traction and stability while walking on sand. The insole is covered between the forefoot portion and the heel portion by an upper portion comprising of two inter-woven flaps allowing easy, no bending, no tying, slip-on and slip-off wearing for the user.

In yet a further embodiment of the present invention, the lugs can protrude from the bottom surface of the outsole approximately 3.0-4.0 mm. The lugged tread is integrated into the bottom surface of the outsole. The footwear has a slip-on closure type and an open forefoot section. The heel section can have extra cushioning to provide comfort to the wearer.

The thickness of the footwear or sandal is consistent with the lugged tread uniformly disposed along the bottom surface. Grooves are formed between the plurality of lugs in the tread design and the lugged tread surface provides traction and stability to the wearer while walking on sand, dirt and other like surfaces. The lugged tread surface does not allow the complete bottom surface of the bottom sole to contact the sand and thus aids in treading the sand.

To the accomplishment of the foregoing and related ends, certain illustrative aspects of the disclosed innovation are described herein in connection with the following description and the annexed drawings. These aspects are indicative; however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
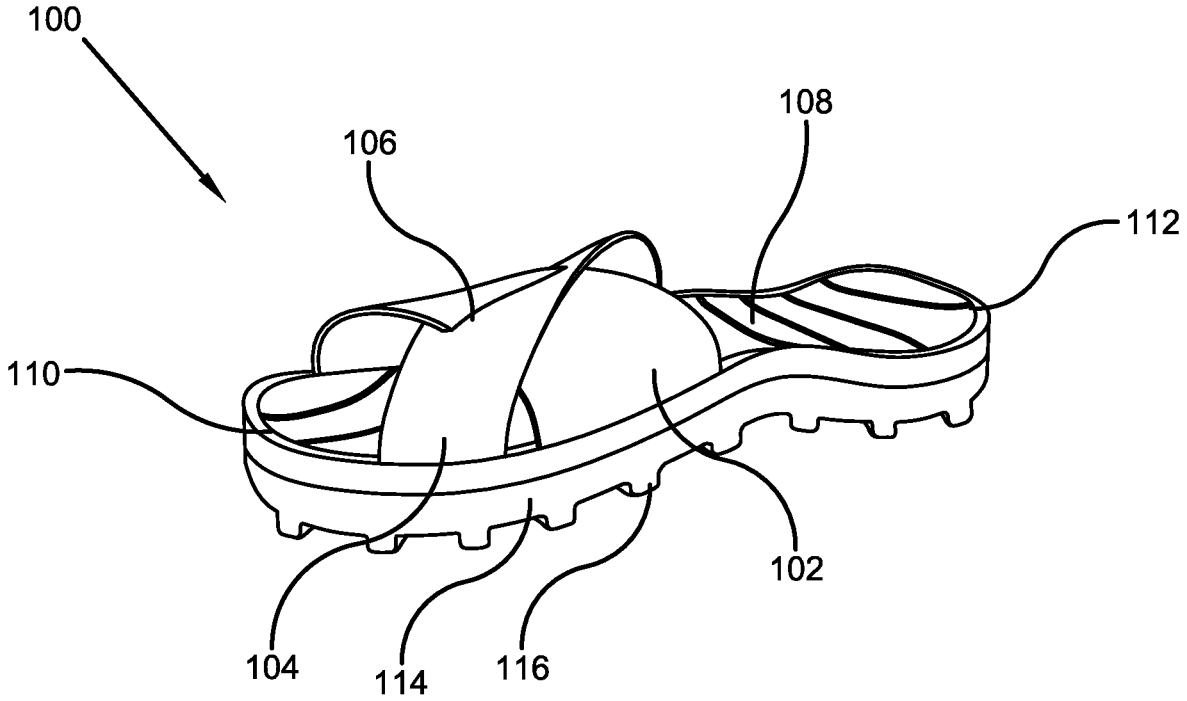
FIG. 1 illustrates a perspective view of one potential embodiment of the optimized sand walking sandal of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an article of footwear that is optimized for walking on sand, dirt, gravel and other similar surfaces. There is also a long-felt need in the art for an article of footwear that increases traction and stability for a wearer. Additionally, there is a long-felt need in the art for an article of footwear that is easy to wear, is not ruined by sand, dirt, and water, and dries readily. There is a long-felt need in the art for such an article of footwear that is also flexible and provides cushioning and support to the heel of a wearer. Moreover, there is a long-felt need in the art for such an article of footwear that can be easily slipped on and off without the need for bending and tying. Further, there is a long-felt need in the art for such an article of footwear configured so the footwear does not accumulate sand or dirt and does not allow the wearer to easily slip out of the footwear while walking on sand, dirt, or other like surfaces. Finally, there is a long-felt need in the art for such an article of footwear to be optimized for walking on sand, dirt, and other like surfaces, while also able to be worn in any other outdoor or indoor setting.

The present invention, in one exemplary embodiment, is an article of footwear for comfortable walking on sand and other like surfaces. The article includes a top sole having a heel cup at the rear portion, a bottom sole, a tread design comprised of a plurality of lugs disposed uniformly along the surface of the bottom sole and an upper portion formed of a pair of inter-woven flaps. Each flap is flexible and generally rectangular and is sewn to the top sole along the longitudinal edges of the top sole. One of the flaps has a slit through which the other flap passes through to form the inter-woven structure. The treads are patterned like a pattern on a tractor tire to provide more traction on sand, dirt, gravel, and other like surfaces.

Referring initially to the drawings, FIG. 1 illustrates a perspective view of one potential embodiment of the optimized sand walking sandal of the present invention in accordance with the disclosed architecture. The optimized sand walking sandal 100 of the present invention is optimized for walking in sand and maintains stability on gravel, grass, sand and other like surfaces. The sandal 100 is particularly useful for walking on beaches or other sandy areas where sand often enters and gets trapped inside a user's footwear.

The sandal 100 has a solid insole 108 glued or sewn to a bottom sole 114. The insole 108 is shaped and dimensioned to conform to the shape and anatomy of the foot of a user.

To support the foot of a user, two inter-woven upper flaps 102,104 are sewn to the insole 108. A first flap 102 passes through a slit 106 of the second flap 104 to form an inter-woven structure. The slit 106 extends along the width of the second flap 104. Both the ends of the first flap 102 and the second flap 104 are sewn or glued to the lining of the insole 108. The insole 108 and the bottom sole 114 are compressible, solid and do not allow or there is less chance for sand to enter the insole 108 and the bottom sole 114. The flaps 102,104 define the semi-closed design of the footwear 100.

The sandal/slip-on footwear 100 has a front end 110 and a rear end 112. The front end 110 is designated to be near the toe portion of a user's foot and the rear end 112 is designated to be near the heel portion of the user when the user is wearing the sandal 100. The flaps 102,104 form an open-toe style allowing the user to slip on the footwear with less bending, tying or fastening, and slip off the footwear without bending, untying or unfastening. The upper portion flaps 102,104 cover the foot of the user to provide stability while walking on any surface. The bottom sole 114 has a deep, lugged tread pattern 116 for providing traction and stability while walking. The lugged tread design 116 provides traction and lessens sinking of the sandal 100 into soft sand or wet sand.

The flaps 102, 104 are flexible and can conform to the shape of the foot of a user. The size of the insole 108 and the bottom sole 114 universally conforms to the size and shape of the sandal-wearer's foot. The slip-on footwear 100 can be made available in various sizes, styles, and designs to accommodate all male, female and child users.

Figure 2:
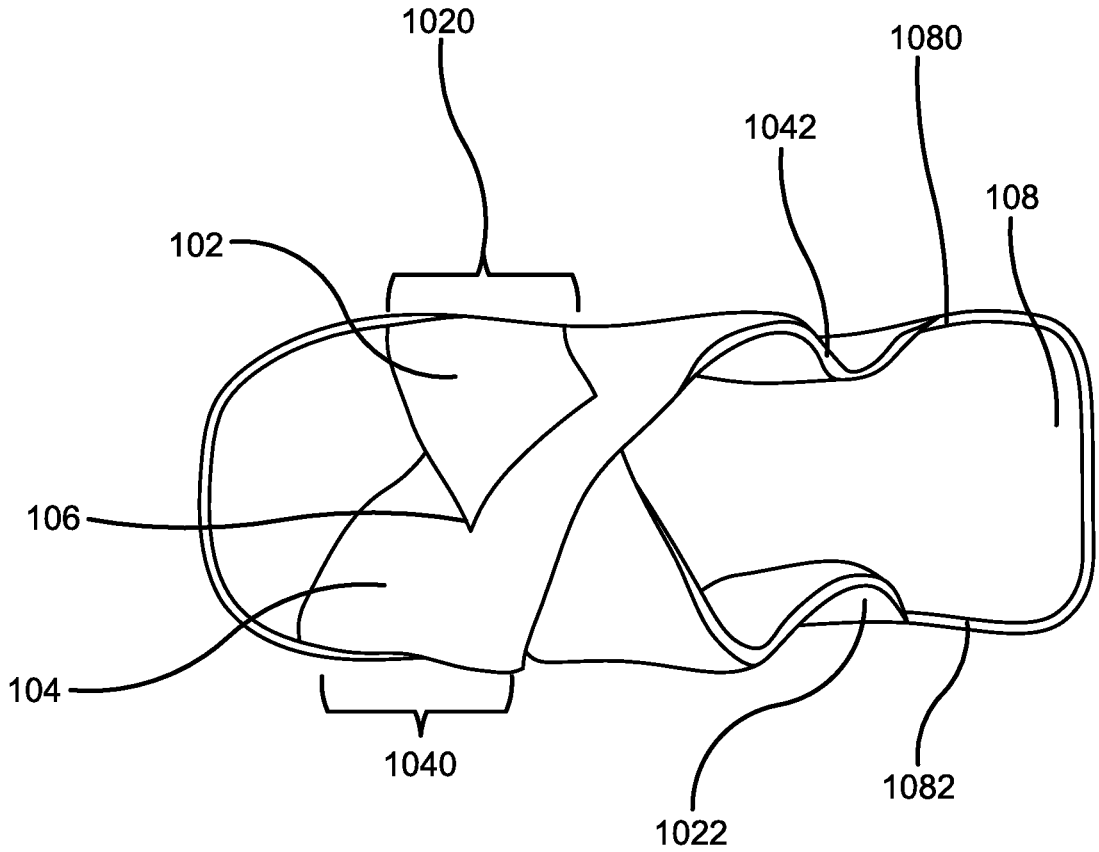
FIG. 2 illustrates a top perspective view of one potential embodiment of the optimized sand walking sandal of the present invention in accordance with the disclosed architecture.

FIG. 2 illustrates a top perspective view of one potential embodiment of the optimized sand walking sandal of the present invention in accordance with the disclosed architecture. The first upper flap 102 is attached to the insole, being sewn along the linings of the insole 108. As shown, one end of the first flap 102 is sewn at 1020 along a first lining 1080 and the other end of the upper flap 102 is sewn along the opposite lining 1082 at 1022. Similarly, one end of the second flap 104 is sewn at 1040 along the lining 1082 and the other end is sewn at 1042 along the lining 1080. It should be noted that any other method, such as glue, known in the art for attaching the upper flaps 102,104 to the insole 108 can be used as per the present invention.

The size and the placement of the upper flaps are such that the toe portion and the heel portion of a wearer's foot is not covered by the upper flaps, thus, providing a relaxed feel to the wearer. The toe portion lies on the forefoot portion of the sole 108. The first flap 102 passes through the slit 106 of the second flap 104 to provide a stable upper portion for the wearer. The top sole or insole 108 provides adequate arch support and heel cushioning, thereby allowing a wearer to wear the footwear 100 for a long period of time on all types of surfaces and especially on the beach.

Figure 3:
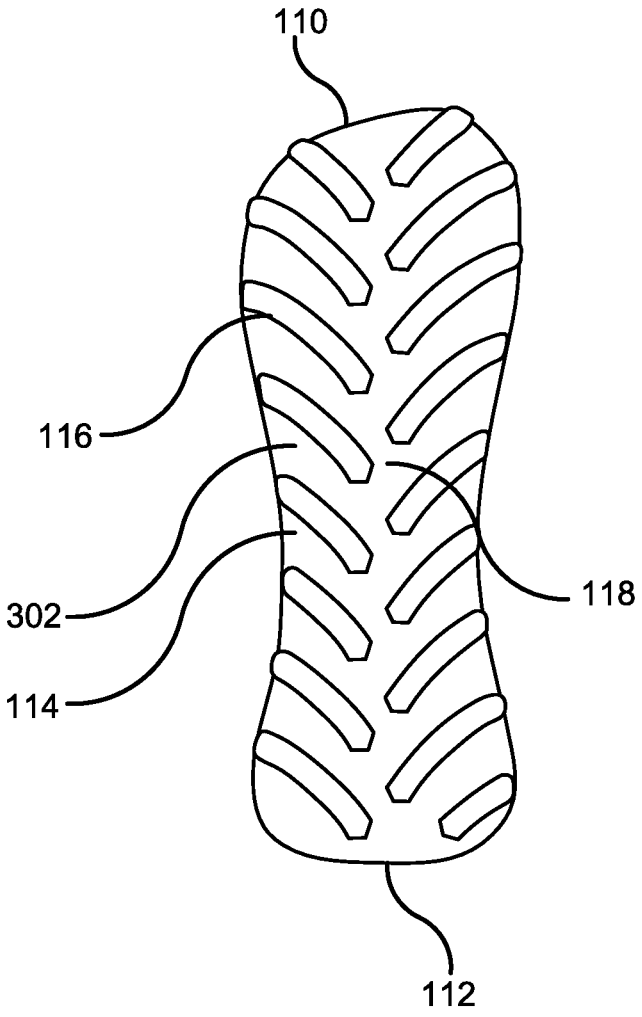
FIG. 3 illustrates a bottom perspective view of one potential embodiment of the optimized sand walking sandal of the present invention in accordance with the disclosed architecture.

FIG. 3 illustrates a bottom perspective view of one potential embodiment of the optimized sand walking sandal of the present invention in accordance with the disclosed architecture. The bottom sole 114 is made up of a combination of wear resistant rubber, silicone material, polyurethane or ethylene vinyl acetate. The bottom surface 302 of the sole 114 has a plurality of lugs 116. The lugs 116 are present across the bottom surface 302 and towards the edges of the sole 114 from the longitudinal central axial line 118, extending from the rear end 112 of the sole 114 to the front end 110 of the sole 114. The lugs 116 consist of two substantially parallel sets, each set uniformly distributed along the longitudinal central axial line 118 of the sole. The two sets of lugs are staggered along the longitudinal central axial line 118. The two sets of lugs extend angularly from the longitudinal central axial line 118. The two sets of lugs have opposite handedness with respect to their angularity with the longitudinal axial line 118. The lugs 116 provide excellent traction on sand and do not allow deep sinking of the sandal 100 into soft or wet sand. The deep, angled lugs 116 provide excellent traction in sand, dirt, snow, mud, grass and all other like surfaces. The configuration of the lugs 116 increases the contact surface with the sand and, therefore, increases traction. The lugs reduce the tendency for the sandal 100 to sink into the sand. The lugs 116 also support activities such as running and playing volleyball performed on sandy surfaces.

Figure 4:
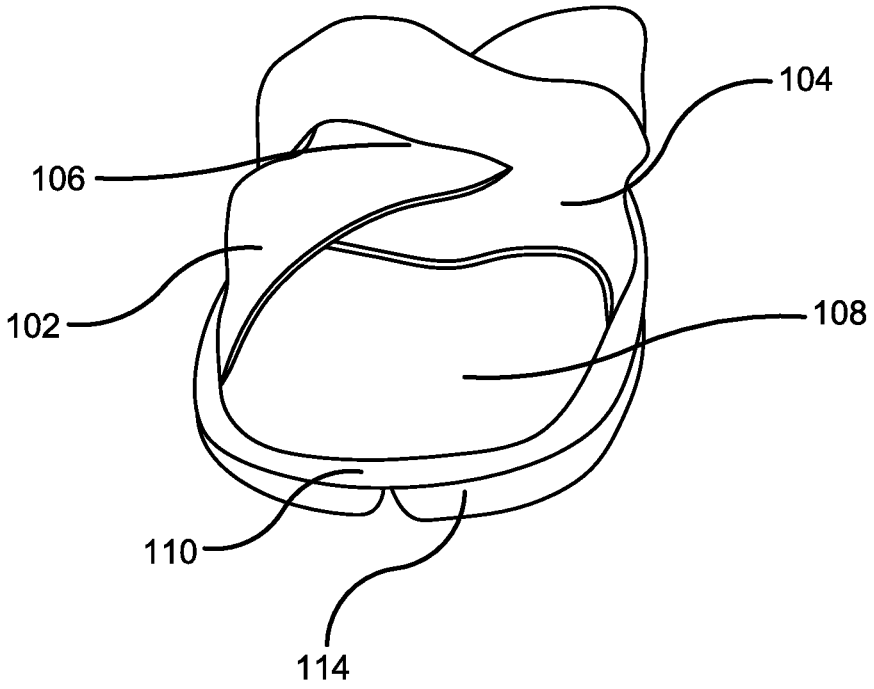
FIG. 4 illustrates a front perspective view of one potential embodiment of the optimized sand walking sandal of the present invention in accordance with the disclosed architecture.

FIG. 4 illustrates a front perspective view of one potential embodiment of the optimized sand walking sandal of the present invention in accordance with the disclosed architecture. The front end 110 is near to the toe portion (the toe portion contacts the sole at the forefoot portion) of a user wearing the sand footwear 100. The foot of a wearer fits comfortably under the upper flaps 102,104. The flaps 102, 104 are inter-woven through a slit 106 present across the flap 104. The toes of the foot can easily move in the planar, dorsal and transverse directions while wearing the slip-on footwear 100.

The insole 108, bottom sole 114 and the upper flaps 102,104 can be of the same color or of different color combinations. The colors may vary and be fluorescent or phosphorescent. The insole 108 and the bottom sole 114 can be made of the same material or different materials, and are permanently sewn or glued to each other. The insole 108 surface can have a logo or trademark for branding or advertising purposes.

Figure 5:
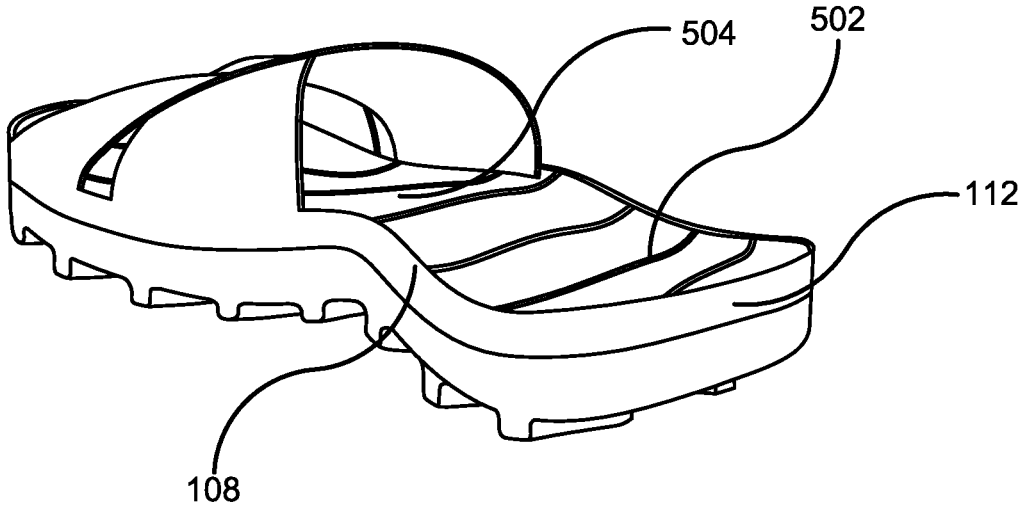
FIG. 5 illustrates a rear perspective view showing the heel cup in the insole of the optimized sand walking sandal of the present invention in accordance with the disclosed architecture.

FIG. 5 illustrates a rear perspective view showing the heel cup in the insole of the optimized sand walking sandal of the present invention in accordance with the disclosed architecture. To provide comfort to a user, the insole 108 conforms to the general anatomical structure of the foot of a person. To absorb shock and provide support to the heel of a wearer, the rear section of the insole 108 has a heel cup 502. The heel cup is slightly depressed into the insole 108. The heel cup portion 502 can have extra cushioning or targeted pressure points to comfort the wearer.

The present invention provides a new, lightweight footwear optimized for walking on sand, that is reasonably inexpensive to manufacture with respect to both materials and labor, and therefore, can be sold at marketplace value to the consuming public, thereby making such footwear economically available to the buying public. The footwear 100 provides an innovative design and tread pattern on the bottom sole and provides adequate air passages to the wearer. The footwear 100 is easily modified to include heels with different styles. The footwear 100 enables the wearer to be comfortable while walking and standing on sand, dirt, gravel and other like surfaces. The article of footwear 100 is ideal for beach walking or running and has a slip-resistant bottom sole or outsole. The material of the footwear is compatible with ocean water and dries quickly. The footwear 100 provides adequate arch and heel support and can have waterproof polyester webbing.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "optimized sand walking sandal", "article of footwear", "slip-on beach footwear", "sandal", "footwear", "slip-on footwear", and "footwear device" are interchangeable and refer to the optimized sand walking sandal 100 of the present invention.

Notwithstanding the forgoing, the optimized sand walking sandal 100 of the present invention can be of any suitable size and configuration as is known in the art without affecting the overall concept of the invention, provided that it accomplishes the above-stated objectives. One of ordinary skill in the art will appreciate that the size, configuration and material of the optimized sand walking sandal 100 as shown in the FIGS. are for illustrative purposes only, and that many other sizes and shapes of the optimized sand walking sandal 100 are well within the scope of the present disclosure. Although the dimensions of the optimized sand walking sandal 100 are important design parameters for user convenience, the optimized sand walking sandal 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A sandal comprising:

an insole configured to be in contact with a sole of a foot the insole, including a heel cup at least partially embedded below an upper surface of the insole;

an insole and outsole integrally formed as a unitary composite structure including rubber and a cushioning component, the outsole having a spaced tread pattern with deep grooves and diagonal lugs arranged at an angle relative to a longitudinal axis to provide traction and stability on soft or uneven surfaces; and a pair of flaps formed of a flexible material, the material selected from leather, canvas, mesh, or woven textile, a first flap of the pair of flaps extending from a first side of a forefoot region to a second side of a midfoot region and having an opening therein, a second of the pair of flaps extending from the second side of a forefoot region to the first side of the midfoot region, the second flap having a width substantially the same as the opening and the second flap passes through the opening in the first flap to retain the foot on the insole.

2. The sandal of claim 1, wherein the insole and outsole consist essentially of rubber.

3. The sandal of claim 1, wherein the cushioning component is selected from memory foam, gel, or ethylene-vinyl acetate (EVA).

4. The sandal of claim 3, wherein the cushioning component is embedded within the rubber of the insole.

5. The sandal of claim 3, wherein the cushioning component is within the heel cup of the insole.

6. The sandal of claim 1, wherein the insole further includes an arch support integrally molded with the heel cup.

7. The sandal of claim 6, wherein the arch support extends longitudinally along at least one-third of the insole length.

8. The sandal of claim 1, wherein the outsole further comprises a high-void volume tread having gaps and grooves about one-quarter inch deep with raised lugs arranged at a high cord angle.

9. The sandal of claim 1, wherein the pair of flaps is fixedly secured to the insole.

10. The sandal of claim 9, wherein the flaps are secured by stitching positioned along a perimeter of the flaps and extending through the insole into the outsole.

11. The sandal of claim 10, wherein the stitching is a stitch-down construction formed by pulling a surface of the insole outward and stitching through the insole into the outsole.

12. The sandal of claim 1, wherein the outsole further includes staggered, non-touching chevron-shaped lugs.

13. The sandal of claim 12, wherein the chevron-shaped lugs are arranged in alternating orientation along the longitudinal axis of the outsole.

14. The sandal of claim 12, wherein the lugs are formed of wear-resistant rubber.

15. The sandal of claim 1, wherein at least one of the crisscrossed flaps is formed of a breathable material selected from canvas, mesh, or woven textile.

16. The sandal of claim 15, wherein the crisscrossed flaps are both formed of a breathable material selected from canvas, mesh, or woven textile.

17. The sandal of claim 1, wherein the crisscrossed flaps are oriented diagonally relative to the longitudinal axis of the sandal.

18. The sandal of claim 17, wherein the diagonal orientation crosses a midfoot region of the insole.

19. The sandal of claim 1, wherein the flaps are positioned at a slanted angle to connect an upper portion of the sandal to the insole through the outsole.

20. The sandal of claim 19, wherein the stitching extends around a perimeter of the flaps.

* * * * *